106-15.05 SR
1/8/85 XR 4,492,766

United States Patent [19]
Zverina et al.

[11] Patent Number: 4,492,766
[45] Date of Patent: Jan. 8, 1985

[54] SPRAY-COATING MATERIAL

[75] Inventors: Karel Zverina; Petr Kroupa, both of Prague, Czechoslovakia

[73] Assignee: Ceskoslovenska akademie ved, Prague, Czechoslovakia

[21] Appl. No.: 500,616

[22] Filed: Jun. 3, 1983

[30] Foreign Application Priority Data

Jun. 11, 1982 [CS] Czechoslovakia ..... 4350-82

[51] Int. Cl.[3] ..... C04B 35/08; C04B 35/48
[52] U.S. Cl. ..... 501/104; 106/15.05; 501/117; 501/118; 501/119; 501/121; 501/123; 501/125
[58] Field of Search ..... 106/15.05, 18.11, 18.12; 428/920, 921; 427/190, 193, 279; 501/104, 117, 118, 121, 119, 123, 125

[56] References Cited

U.S. PATENT DOCUMENTS 1,969,099 8/1934 Ryschkewitsch ..... 501/104
2,976,166 3/1961 White et al. ..... 427/193
4,050,956 9/1977 Bruin et al. ..... 427/193

FOREIGN PATENT DOCUMENTS 2073169 10/1981 United Kingdom .

*Primary Examiner*—V. P. Hoke
*Attorney, Agent, or Firm*—Jeffers, Irish & Hoffman

[57] ABSTRACT

Spray-coating materials having a high heat-resistance and thermal conductivity for the surface protection of materials. The spray-coating material consists of 8–35 wt. % magnesium oxide MgO or calcium oxide CaO, 2–10 wt. % of beryllium oxide BeO and 55–90 wt. % of aluminum oxide $Al_2O_3$, zirconium dioxide $ZrO_2$, silicon dioxide $SiO_2$, chromic oxide $Cr_2O_3$ and titanium dioxide $TiO_2$. The spray-coating material of the invention can be employed to advantage, for example, in the chemical industry and in metallurgy.

5 Claims, No Drawings

SPRAY-COATING MATERIAL

The invention relates to spray-coating material especially for plasma spray-coating of layers resistant to the combined effects of high and, to a great extent varying temperatures, abrasion and exposure to media having deleterious effects.

Recently, there have become known and commonly used a great amount of various spray-coating materials. There are used especially materials based on ceramic oxides, carbides and borides. By the suitable choice of the composition it is possible to produce materials which are highly heat-proof, such as thorium dioxide $ThO_2$, magnesium oxide MgO, zirconium dioxide $ZrO_2$, Ca $ZrO_3$ or barium oxide BaO, materials suitable for temperatures lower than 2000 degrees C such as aluminum oxide $Al_2O_3$, zirconium dioxide $ZrO_2$ or titanium dioxide $TiO_2$ or materials having other useful properties. Very well known is the resistance of $ZrO_2$ and $Al_2O_3$ in acidic oxidizing medium or the resistance of MgO or CaO in alkaline medium. But for certain special uses, especially for spray-coatings applied on metallic materials, those exposed to the combined effect of varying high temperatures, abrasion and oxidizing media, the properties of these known materials are not convenient, due to their relatively great thermal expansion and their low heat conductivity.

The disadvantages of the known spray-coating materials have been removed by the spray-coating material according to the invention. Such material consists of 8–35 wt. % of a metal oxide selected from the group consisting of magnesium oxide MgO and calcium oxide CaO, 2–10 wt. % of beryllium oxide BeO, and 55–90 wt. % of a metal oxide selected from the group consisting of aluminum oxide $Al_2O_3$, zirconium dioxide $ZrO_2$, silicon dioxide $SiO_2$, chromic oxide $Cr_2O_3$, and titanium dioxide $TiO_2$ alone or in a mixture.

In one embodiment the material advantageously consists of 10–20 wt. % of MgO, 3–7 wt. % BeO, 30–35 wt. % of $Al_2O_3$, 15–25 wt. % $Cr_2O_3$, 8–12 wt. % of $SiO_2$ and 15–23 wt. % of $ZrO_2$. In another embodiment the material consists of 25–32 wt. % of MgO, 4–8 wt. % of BeO, 32–40 wt. % $SiO_2$, and 26–34 wt. % of $ZrO_2$. In a third embodiment the material consists of 15–20 wt. % of MgO, 3–8 wt. % of BeO, 62–80 wt. % of $Al_2O_3$ and 4–6 wt. % of $TiO_2$.

In a further embodiment of the spray-coating material according to the invention, such material contains, based on the amount of the ceramic oxides, 10–15 wt. % of nickel, aluminum, chromium, copper, titan, iron or their mixture.

The protective coatings based on these materials show an excellent thermal extension suitable for the coating of ferrous materials which are exposed to heat stress. The invention is further described in the following examples, which illustrate the invention, but do not limit its scope.

EXAMPLE 1

A spray-coating material for the application by a liquid stabilized plasma torch was prepared from 32 wt. % of $Al_2O_3$, 5 wt. % of BeO, 20 wt. % of $Cr_2O_3$, 15 wt. % MgO, 9 wt. % of $SiO_2$ and 19 wt. % of $ZrO_2$. By dry milling the individual components are made free of residual agglomerates; they are screened on a suitable screen to the desired grain size in the range of 0.06 to 0.1 mm, a thoroughly mixed, and in the usual way the mixture is applied to the subjacent material. The spray-coating material is very advantageous for the protection of ferrous metals which are significantly exposed to heat-stress.

EXAMPLE 2

The spray-coating consisting of 28.6 wt. % of MgO, 35.9 wt. % $SiO_2$, 29.5 wt. % $ZrO_2$ and 6 wt. % BeO was prepared in the same way as in Example 1.

EXAMPLE 3

In the same manner as in Example 1, there was prepared a spray-coating consisting of 5 wt. % of $TiO_2$, 73 wt. % of $Al_2O_3$, 5 wt. % of BeO and 17 wt. % of MgO.

EXAMPLE 4

The spray-coating material was prepared as in Example 2 and was enriched by the addition of 28 wt. % of Ni, 12 wt. % of Al and 6 wt. % of Ti having a grain size in the range of 0.01 to 0.03 mm.

EXAMPLE 5

The spray-coating material according to Example 3 was enriched by the addition of 1-wt. % of Cr and 5 wt. % of Fe in the same grain size as in Example 4.

If it is desired that the coating have appreciable electrical conductivity, it is possible to use with advantage as an additive, powdered copper—Cu.

Spray-coating materials according to the invention guarantee a high heat-resistance and a very good adhesion to the subjacent material. The materials can be employed in various technical areas, e.g. in the chemical industry, metallurgy and the like.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Spray-coating material consisting essentially of an admixture of the following metal oxides which admixture consists of 8–35 wt. % of a metal oxide selected from the group consisting of magnesium oxide MgO and calcium oxide CaO, 2–10 wt. % of beryllium oxide BeO, and 55–90 wt. % of a metal oxide selected from the group consisting of aluminum oxide $Al_2O_3$, zirconium dioxide $ZrO_2$, silicon dioxide $SiO_2$, chromic oxide $Cr_2O_3$, and titanium dioxide $TiO_2$ alone or in admixture.

2. Spray-coating material as claimed in claim 1, wherein said metal oxide admixture consists of 10–20 wt. % of magnesium oxide MgO, 3–7 wt. % beryllium oxide BeO, 30–35 wt. % of aluminum oxide $Al_2O_3$, 15–25 wt. % chromic oxide $Cr_2O_3$, 8–12 wt. % of silicon dioxide $SiO_2$ and 15–23 wt. % of zirconium dioxide $ZrO_2$.

3. Spray-coating material as claimed in claim 1, wherein said metal oxide admixture consists of 25–32 wt. % of magnesium oxide MgO, 4–8 wt. % of beryllium oxide BeO, 32–40 wt. % of silicon dioxide $SiO_2$, and 26–34 wt. % of zirconium dioxide $ZrO_2$.

4. Spray coating material as claimed in claim 1, wherein said metal oxide admixture consists of 15–20 wt. % of magnesium oxide MgO, 3–8 wt. % of beryllium oxide BeO, 62–80 wt. % of aluminum oxide $Al_2O_3$ and 4–6 wt. % of titanium dioxide $TiO_2$.

5. Spray-coating material as claimed in claim 1, which further contains, based on the whole weight of the ceramic oxides, 10–50 wt. % of nickel, aluminum, chromium, copper, titanium, iron, or their mixture.

* * * * *